US005754094A

United States Patent [19]

Frushour

[11] Patent Number: 5,754,094

[45] Date of Patent: May 19, 1998

[54] SOUND GENERATING APPARATUS

[76] Inventor: Robert H. Frushour, 2313 Devonshire, Ann Arbor, Mich. 48104

[21] Appl. No.: 520,549

[22] Filed: Aug. 29, 1995

Related U.S. Application Data

[63] Continuation-in-part of Ser. No. 337,984, Nov. 14, 1994, abandoned.

[51] Int. Cl.[6] ..... G08B 3/10

[52] U.S. Cl. ..... 340/384.7; 104/296; 340/384.3; 446/410

[58] Field of Search ..... 340/384.7, 384.3, 340/384.5; 381/61; 434/48; 446/410, 436, 467, 175, 409; 369/21, 31, 63, 64; 104/296

[56] References Cited

U.S. PATENT DOCUMENTS

| | | | |
|---|---|---|---|
| 5,174,216 | 12/1992 | Miller et al. | 446/410 |
| 5,195,920 | 3/1993 | Collier | 446/409 |
| 5,267,318 | 11/1993 | Severson et al. | 340/384.3 |
| 5,555,815 | 9/1996 | Young et al. | 446/410 |

FOREIGN PATENT DOCUMENTS

| | | | |
|---|---|---|---|
| 0446881 | 9/1991 | European Pat. Off. | 446/409 |
| 7801499 | 10/1979 | Switzerland | 446/410 |
| 2063692 | 6/1981 | United Kingdom | 446/409 |

*Primary Examiner*—Brent A. Swarthout
*Attorney, Agent, or Firm*—Young & Basile, PC

[57] ABSTRACT

A sound generating apparatus for movable objects, particularly model trains, generates audible sounds from digital signal representations of actual train sounds prestored in a memory mounted on the object. In one embodiment, the stored digital sound representations are divided into sets, with each set assigned to a different speed range of movement of the object. Each set includes a plurality of subsets, each containing distinct sound representations which can vary in volume and/or pitch. A central processing unit selects the appropriate set from the memory in response to the actual speed of movement of the object and randomly selects the subsets within the selected set as long as the object remains in a given speed range. In another embodiment, a single set is formed of a plurality of subsets. Each subset contains an identical number of sound representations which vary from subset to subset and within each subset in volume and/or pitch. The CPU randomly selects a sound representation from any of the subsets for each of plurality of consecutively generated sounds. Upon sensing speed variations, the CPU adjusts the length of the leader and/or tail end of each sound for faster or slower sound generation.

11 Claims, 5 Drawing Sheets

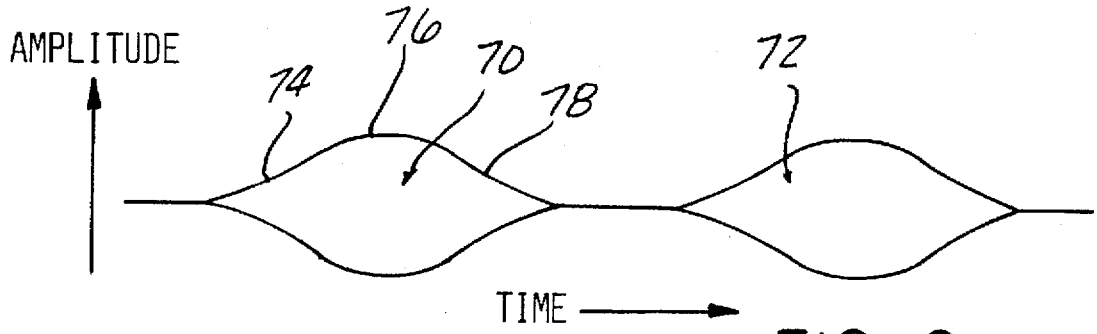
FIG-6
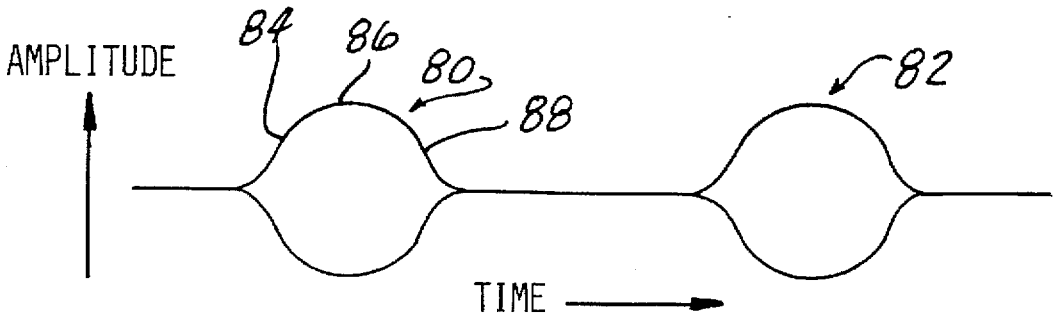
FIG-7
| SUBSET 1 | SUBSET 2 |
|---|---|
| 1. CHUFF | 5. chuff |
| 2. CHuff | 6. CHUFF |
| 3. chuff | 7. CHuff |
| 4. chUFF | 8. chUFF |
FIG-5

SOUND GENERATING APPARATUS

CROSS REFERENCE TO APPLICATION

This application is a continuation-in-part of application Ser. No. 08/337,984, filed Nov. 14, 1994 in the name of Robert H. Frushour and entitled "Sound Generating Apparatus", now abandoned.

BACKGROUND OF THE INVENTION

1. Field of the Invention

The present invention relates, in general, to sound generating apparatus and, specifically, to sound generating apparatus for use with toys, such as model trains.

2. Description of the Art

Sound generating apparatus have been employed with toys, such as model trains, to generate realistic sounds simulating the sounds produced by an actual train.

In the case of a model train, such as a model steam locomotive, the "chuff" sound of a steam locomotive and other train sounds, such as bells, whistles, announcements, brake squeals, etc., have been produced to simulate real train sounds and to provide realism in the use of the model train.

Most train steam engines have four valves that are used to provide steam pressure to drive two pistons, one on each side of the engine. The four valves exhaust steam through the smoke stack, with this exhaust producing the "chug" or "chuff" sound. The "chuff" sound for each individual valve is slightly different since no two valves are exactly alike and each valve may have differing amounts of mechanical wear. Thus, the exhaust sound produces a rhythm that repeats every fourth "chuff".

The pressure of the steam and its volume which is released by the valves are never exactly the same even when the steam engine is running at a constant speed. Therefore, the rhythm of the exhaust sound may remain constant, but each of the four individual exhaust "chuffs" is slightly different each time the engine goes through a complete cycle of four steam exhausts. The result is a very pleasing rhythmic sound that has enough of a chaotic nature so as not to sound like a broken record.

The "chuff" sound of a steam locomotive has been generated for a model train by use of one and possibly two real locomotive sounds which are digitized and stored in a memory. As a magnet mounted on a train wheel passes a reed switch during each revolution of the wheel, a pulse is generated by the switch causing a "chuff" sound to be output from the memory and converted to an audible sound. While changes in the train speed causes the "chuff" sound to be generated at faster or slower rate, the resulting sound still has a staccato sound which does not vary in pitch or volume.

Train sounds have also been synthesized from electronic white noise generators which produce a deeper, more throaty sound which has better listening qualities than stored sounds since the stored sounds give a monotonous, staccato noise that is usually annoying and non-realistic, whereas, sounds synthesized from white noise are richer in tone and not so repetitive due to the chaotic output characteristic of the white noise system.

Separate trigger mechanisms are used to generate the sound of a whistle and, separately, the sound of a bell. The bell and whistle sounds are not tied directly to the speed of the train and are usually produced whenever the train passes by a magnetic field located in close proximity to and at a particular location on the track. The magnetic field, typically generated by a device activated by a pushbutton controlled by the user and located near the speed controller of the model train, closes a reed switch on the train to activate the bell or whistle.

Although the model train operator has the ability to control the bell and whistle sounds, the separate trigger and mechanisms required to generate each sound require setup and the use of additional components. Further, such bell and whistle sounds are not automatically produced as a function of the speed of the train; but are typically generated only when the train passes a particular location on the track layout or when the operator depresses a pushbutton or actuates a switch.

As a train steam engine increases in speed, the pistons move back and forth at a faster rate and the exhaust valves open and close more rapidly. The result is that the exhaust "chuff" sound becomes shorter in duration. In order to shorten digitally recorded "chuff" sounds, prior art model train sound systems simply cutoff each "chuff" sound the moment the next "chuff" sound begins to play in response to the next input signal typically from the train wheel. However, this provides an abrupt cutoff of each "chuff" sound at higher train speeds which can be rather displeasing to the ear.

Thus, it would be desirable to provide a sound generating apparatus particularly usable with toys, such as model trains, which overcomes the deficiencies associated with previously devised sound generating apparatus used with toys. It would also be desirable to provide a sound generating apparatus which generates random sounds of different volume and/or pitch at different rates in response to changes in the speed of movement of the toy. It would also be desirable to provide a sound generating apparatus for use with toys, such as model trains, which is easy to implement. It would also be desirable to provide a sound generating apparatus specifically for model trains which is capable of generating all of the various sounds associated with a real train. It would also be desirable to provide a sound generating apparatus specifically for model trains which proportionally shortens the playback of selected pre-recorded sounds in response to increased train speed.

SUMMARY OF THE INVENTION

The present invention is a sound generating apparatus for a movable object, particularly a movable toy, such as a model train.

In a first embodiment, the sound generating apparatus includes a memory means for storing digital representations of actual sounds in a plurality of discrete sets, each set associated with a distinct condition of the object. Means are mounted on the movable object for generating periodic output signals during movement of the object. A central processing means is connected to the memory means and is responsive to the periodic output signals and executes a control program stored in the memory means for computing the speed of the object and for selecting and outputting one of the discrete sets of digital representations of sounds corresponding to a distinct condition of the object. An audible sound generator means is responsive to the selected digital representations of sounds from the central processing means for converting the digital representations of sounds to audible sounds.

Preferably, the digital representations of sounds stored in the memory means are digitized from actual sounds associated with movement of a full size object which the movable object replicates on a reduced scale.

The central processing means includes means for detecting a change in the rate of input of the periodic output signals for selecting a different set of digital representations of sounds stored in the memory. Preferably, each set of digital representations of sounds are assigned to a different selected speed range of movement of the object.

The means for generating the periodic output signals preferably comprises a switch means, mounted on the object, for generating an output signal for each selected amount of movement of the object.

In the first embodiment, each set of digital representations of sounds is formed of a plurality of discrete subsets of sounds. The central processing means selects one of the digital representations of sounds from one subset upon receiving each periodic output signal. The central processing means also includes means for randomly selecting the subsets of the digital representations of sounds from each set of digital representations of sounds.

In a second embodiment, a single set of digital representations of sounds are formed of a plurality of discrete subsets, each subset including an identical number of individual sound representations, such as four, which sound representations vary within each subset in either volume and/or pitch. In this second embodiment, the central processing means randomly selects and consecutively outputs one of at least first, second, third and fourth sound representations from each of the plurality of subsets each time the complete set of four sound representations is generated. In this manners the central processing unit is capable of generating a random or chaotic series of sound representations which provides a pleasing, non-repetitious sound more closely approximating the actual sounds generated by a train steam engine.

The central processing means is also capable of varying the duration or length of at least the leading and preferably both the leading and trailing portions of each generated sound representation in proportion to the computed speed of the object or train. This is especially advantageous at higher speeds in which the duration of each sound representation is shortened.

In a preferred embodiment, the movable object is a model train. The switch means preferably comprises one or more magnets mounted on a movable wheel of the train which moves into close proximity with a reed switch fixedly mounted on the train once for each revolution of the train wheel. The set of digital representations of sounds stored in the memory means comprise digitized actual sounds from a real train. Each subset of such digital representations of sounds associated with a particular speed range of movement of the model train includes all of the normal sounds associated with a real train, including the distinctive "chuff" sound of a steam locomotive as well as whistles, bells, announcements, brake squeals, etc., which sounds are digitized and stored in the memory for generation as audible sounds in response to the speed of the model train.

The sound generating apparatus of the present invention provides unique features not previously provided in sound generating apparatus particularly used with toys, such as model trains. The audible sounds produced by the subject sound generating apparatus more realistically approximate actual sounds produced by an actual train since the sounds stored in the memory as digitized representations of actual sounds are stored in a plurality of sets, one set for each of a preassigned speed range of the train, with the sounds in each set stored with varying volume and/or pitch. Further, the subsets are randomly selected within a particular train speed range such that the audible sounds generated by the apparatus appear to be random, i.e. a lengthy sequence of sounds before any repeat. When the sound generating apparatus is used on a model train, all of the sounds generated by the apparatus including whistles, bells, brake squeals, etc. are generated solely in response to the speed of the train and not the position of the train on the track. This eliminates the necessity of user input, i.e., the depression of a pushbutton or movement of a switch, to activate a whistle, bell, etc., at a particular location on the track layout. The present apparatus also eliminates the switches and other devices generating magnetic fields at various locations on the track layout to generate the appropriate sounds.

Further, in the case of a model train, the speed of the train may vary due to track conditions, such as dirt on the tracks, inclines, curves, etc. Thus, the sounds generated by the apparatus also vary similar to a real train. Further, the sounds generated by the present apparatus change based solely on the speed of the train. Thus, trains with different voltage requirements for identical speeds are unaffected and can easily use the present apparatus without modification. As the proper sounds are generated at preassigned speeds based solely on engine speed, the amount of power required to move the train around the layout due to the number of cars attached to the train plays no role in the generation of the sounds. Other train sounds, such as whistles, bells, announcements, etc., can be generated at realistic times during movement of the train around the track layout to more realistically simulate the actions and sounds associated with a real train.

BRIEF DESCRIPTION OF THE DRAWINGS

The various features, advantages and other uses of the present invention will become more apparent by referring to the following detailed description and drawing in which:

FIG. 5 is a chart depicting the arrangement of distinct sound representations in two subsets according to one embodiment of the present invention;

FIG. 6 is an amplitude versus time pictorial representation of the generation of two pre-recorded digital sound representations; and FIG. 7 is an amplitude versus time pictorial representation of two digital sound representations in which both the leading and trailing end portions of each sound representation have been proportionally shortened in response to a proportional increase in object speed.

DESCRIPTION OF THE PREFERRED EMBODIMENTS

Figure 1:
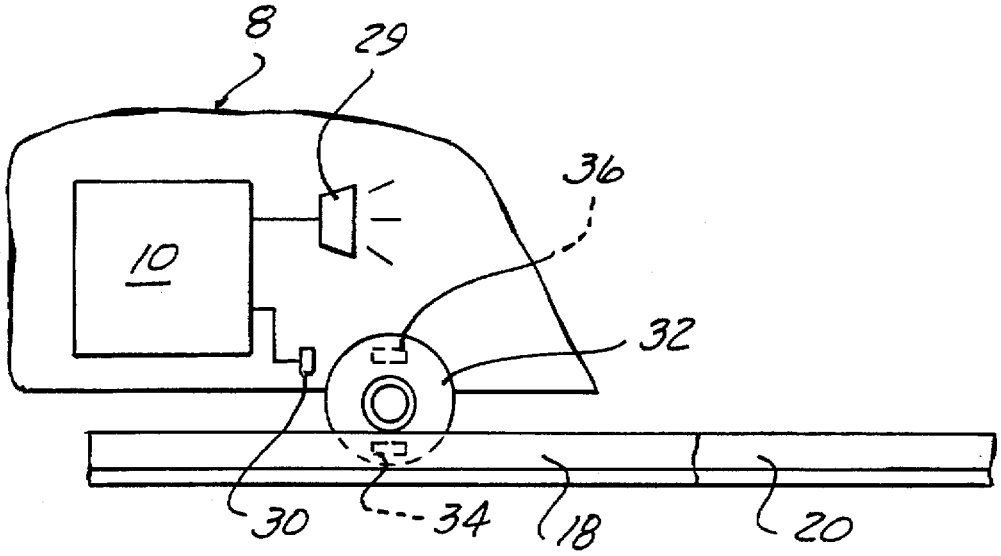
FIG. 1 is a pictorial representation of a model train employing a sound generating apparatus constructed in accordance of the teachings of the present invention.
Figure 2:
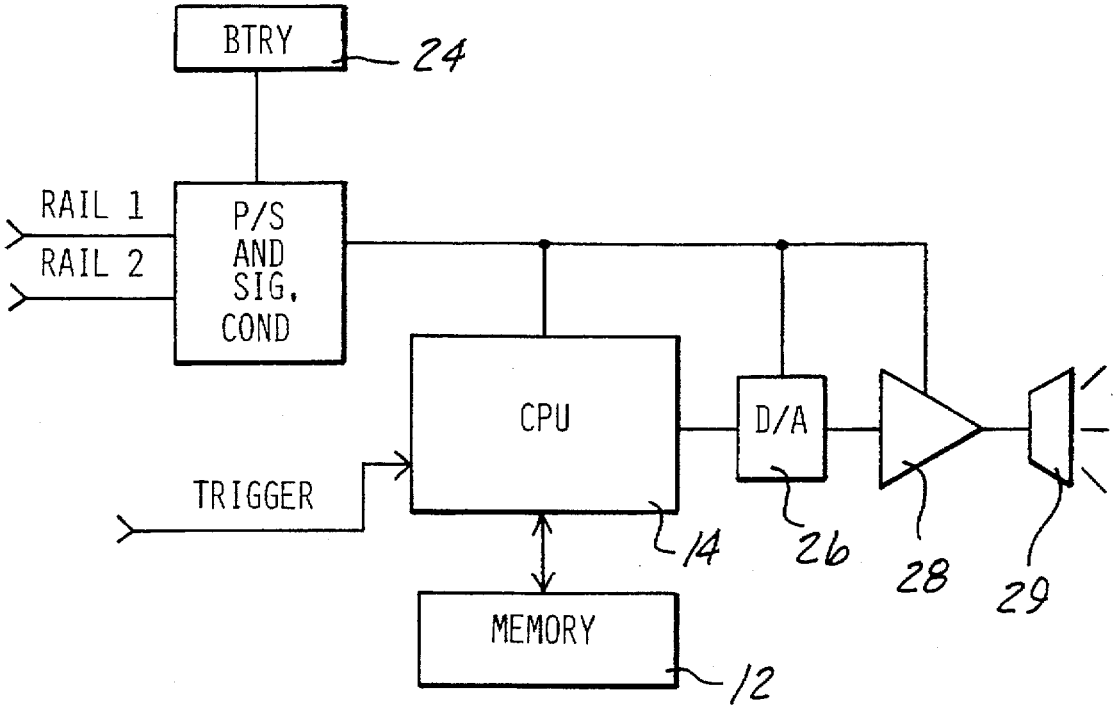
FIG. 2 is a block diagram showing the major components of the sound generating apparatus of the present invention.

Referring now to the drawing, and to FIGS. 1 and 2 in particular, there is depicted a sound generating apparatus 10 for use in toys which generates sounds simulating the sounds of a real object which the toy replicates.

The following description of the sound generating apparatus of the present invention as used with a model train 8 will be understood to be by example only as the sound generating apparatus, without extensive modification, can be adapted to generate sounds for other toys.

As a first step in using the sound generating apparatus 10 of the present invention, real train sounds, such as the distinctive "chuff" sounds of a steam locomotive, as well as other sounds, such as bells, whistles, brake squeals, and voice announcements such as "all aboard" or an upcoming station name, are recorded and then digitized into digital signal representations of the real sounds by using conventional sound digitizing techniques. These digital sound representations are stored in binary form in a memory 12 in a predetermined format as will be described hereafter.

The memory 12 may take the form of any suitable memory. Preferably, two EPROM memories 12 are employed in the sound generating apparatus 10 of the present invention. In a first embodiment, the sounds recorded from a real steam locomotive are recorded at different speeds of the real locomotive. The total speed range of the model train is divided into a plurality of distinct speed ranges, such as four speed ranges, by example only, with a set of digital signal representations of real locomotive sounds generated at different real train speeds being assigned to each speed range. By way of example only, each speed range includes a set of twelve distinctive "chuff" sounds, with each set divided into three subsets of four sounds. The use of four sounds per subset more closely simulates the real sounds produced by a two cylinder steam locomotive which generates four sounds or "chuffs" per engine cycle. As each set of digital sound representations stored in the memory 12 is associated with a different train speed range, the sounds in each set will be generated at a faster rate in each ascending speed range based on the speed of the model train 8. For example, the four distinct sounds in each subset in the first set, associated with the slowest speed of the model train 8 will be generated as "chuff-chuff CHUFF-chuff". The capitalized "CHUFF" represents a louder sound as would occur periodically from a real steam locomotive. Correspondingly, the four distinct sounds in each subset in the second, third or fourth sound sets will be generated at progressively faster rates to simulate the faster generation of such sounds associated with faster train speeds.

The manner in which each subset of sounds is selected and generated will be described hereafter in association with a description of the use of the sound generating apparatus 10 of the present invention.

FIG. 2 depicts a block diagram of the major components of the sound generating apparatus 10 of the present invention. The memory 12 communicates with a central processing unit, such as a microprocessor. The central processing unit 14 receives one or more trigger inputs 16, as described hereafter, which are generated during movement of the train 8 on the tracks 18 and 20, as shown in FIG. 1. The central processing unit 14 determines the rate or input of the trigger signal 16 to calculate the speed of the train 8. Electric power obtained from the tracks or rails 18 and 20 in a conventional manner is received by power supply and signal conditioning circuits 22 which provide low level D.C. power to the microprocessor 14 and the other electronic elements employed in the sound generating apparatus 10. A battery 24, mounted on the train 8, is provided to supply power to the sound generating apparatus 10 when the track voltage is too low to operate the sound generating apparatus 10.

In general, the central processing unit 14, based on the trigger input 16 calculates the speed of the train 8 on the tracks 18 and 20 and selects the appropriate sound subset from the memory 12 corresponding to the train speed and serially outputs each digital sound representation in the selected subset to a digital to analog converter 26 wherein the digital sound representations are converted to analog signals. These signals are amplified in an dual channel audio amplifier 28 and output through an appropriate audio speaker 30 which broadcasts the sounds from the train 8 as the train 8 moves along the tracks or rails 18 and 20.

Referring briefly again to FIG. 1, the trigger input, according to one embodiment of the present invention, comprises a reed switch 30. The reed switch 30 is mounted on the train 8 in close proximity to one of the rotatable wheels 32 of the train 8. At least one and possibly two or more magnets 34 and 36 are mounted at spaced locations on the wheel 32, preferably in diametrically opposed positions in the case of two magnets 34 and 36. In use, as the train wheel 32 rotates during movement of the model train 8 around the tracks 18 and 20, each magnet 34 or 36 will move into close proximity with the reed switch 30 once for each revolution of the train wheel 32. The magnet 34 creates a magnetic field which closes the contact of the reed switch 30 and generates a trigger signal which is input to the sound generating apparatus 10. In the case of two magnets 34 and 36, two input signals or pulses will be generated during each revolution of the train wheel 32.

Figure 3A:
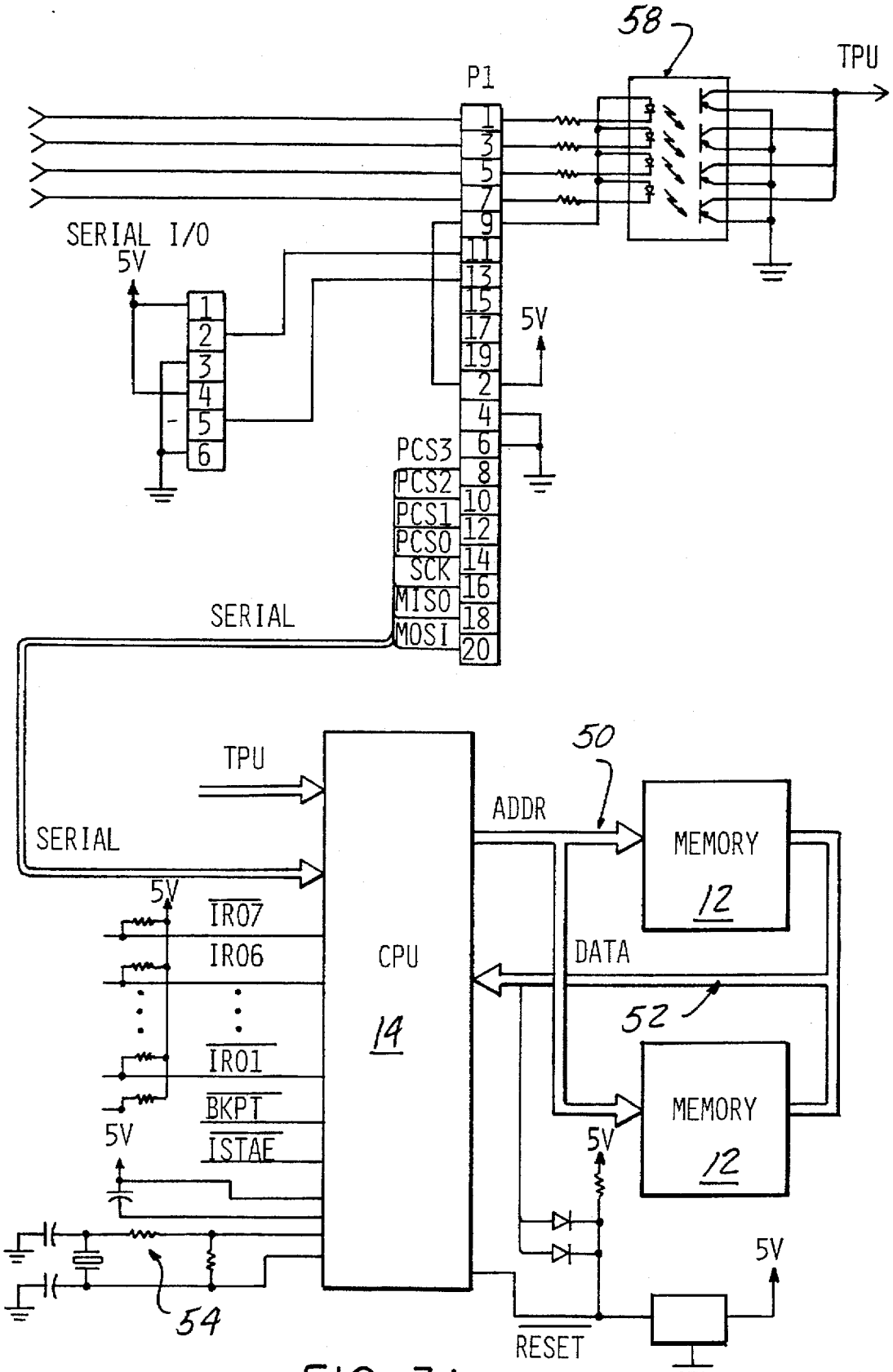
FIG. 3A is a schematic diagram showing the central processing unit and the memory employed in the sound generating apparatus depicted generally in FIG. 2.

The output of the reed switch 30, labeled "trigger zero" is input through appropriate connectors and mounted on the model train 8 to central processing unit 14 as shown in FIG. 3A.

Figure 4A:
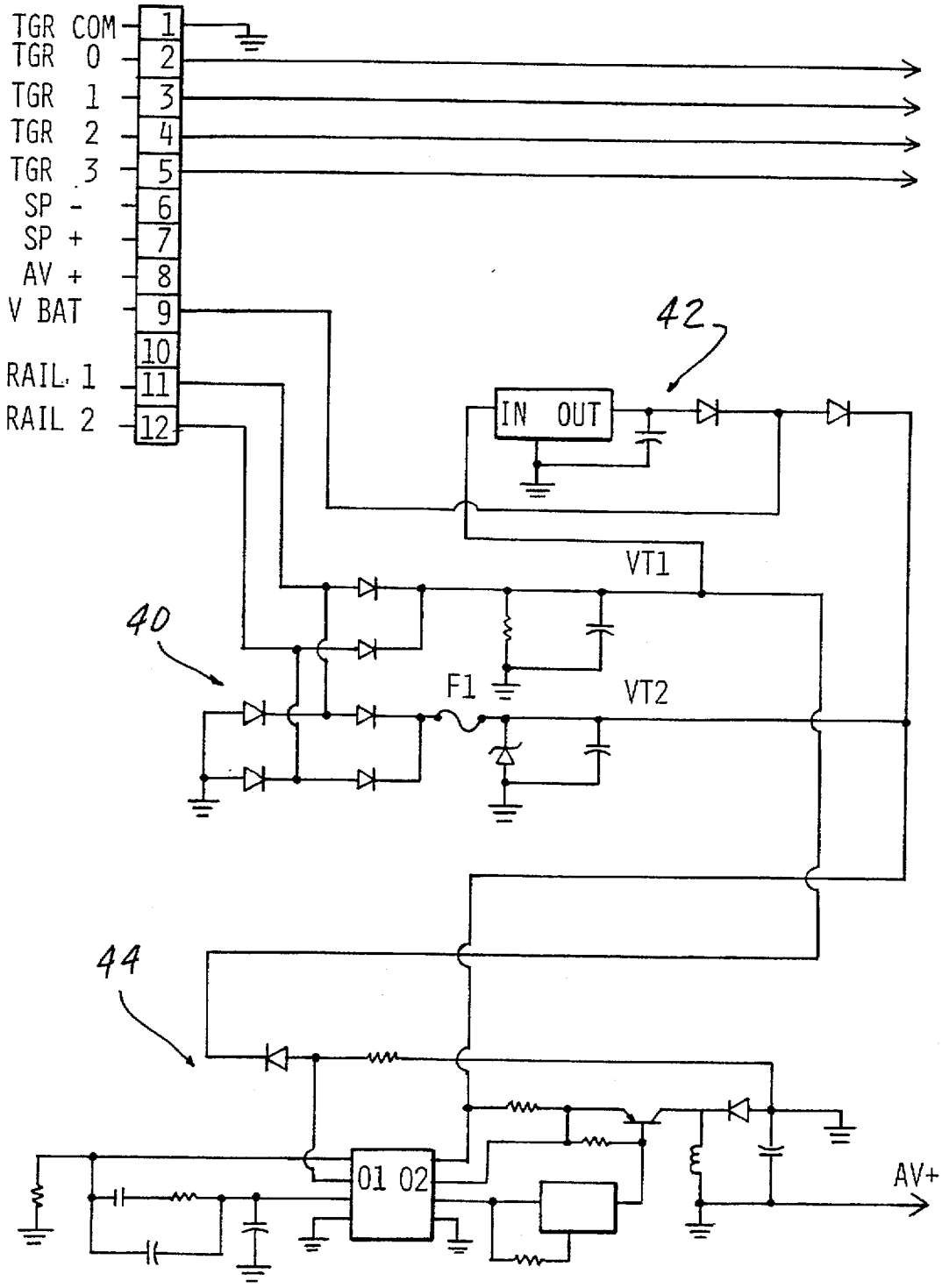
FIGS. 4A and 4B are schematic diagrams showing the remainder of the circuitry employed in the sound generating apparatus depicted generally in FIG. 2.

As shown in FIG. 4A, the voltage picked up from the tracks 18 and 20, and labeled "rail 1" and "rail 2" is supplied to the power supply and signal conditioning circuitry 22 which includes an rectification/overvoltage protection circuit 40. The circuit 40 provides rectification since the plurality of the source current reverses when the direction of movement of the train 8 reverses. The circuit 40 also limits the maximum input voltage from the tracks 18, 20 to a safe level. The voltage from the circuit 40 is output on lines VT1 and VT2 to a battery charger circuit 42 including a constant voltage battery charger IC Model No. LM2940 from National Semiconductor which charges the battery 24 whenever the track voltage exceeds 5V.

Figure 4B:
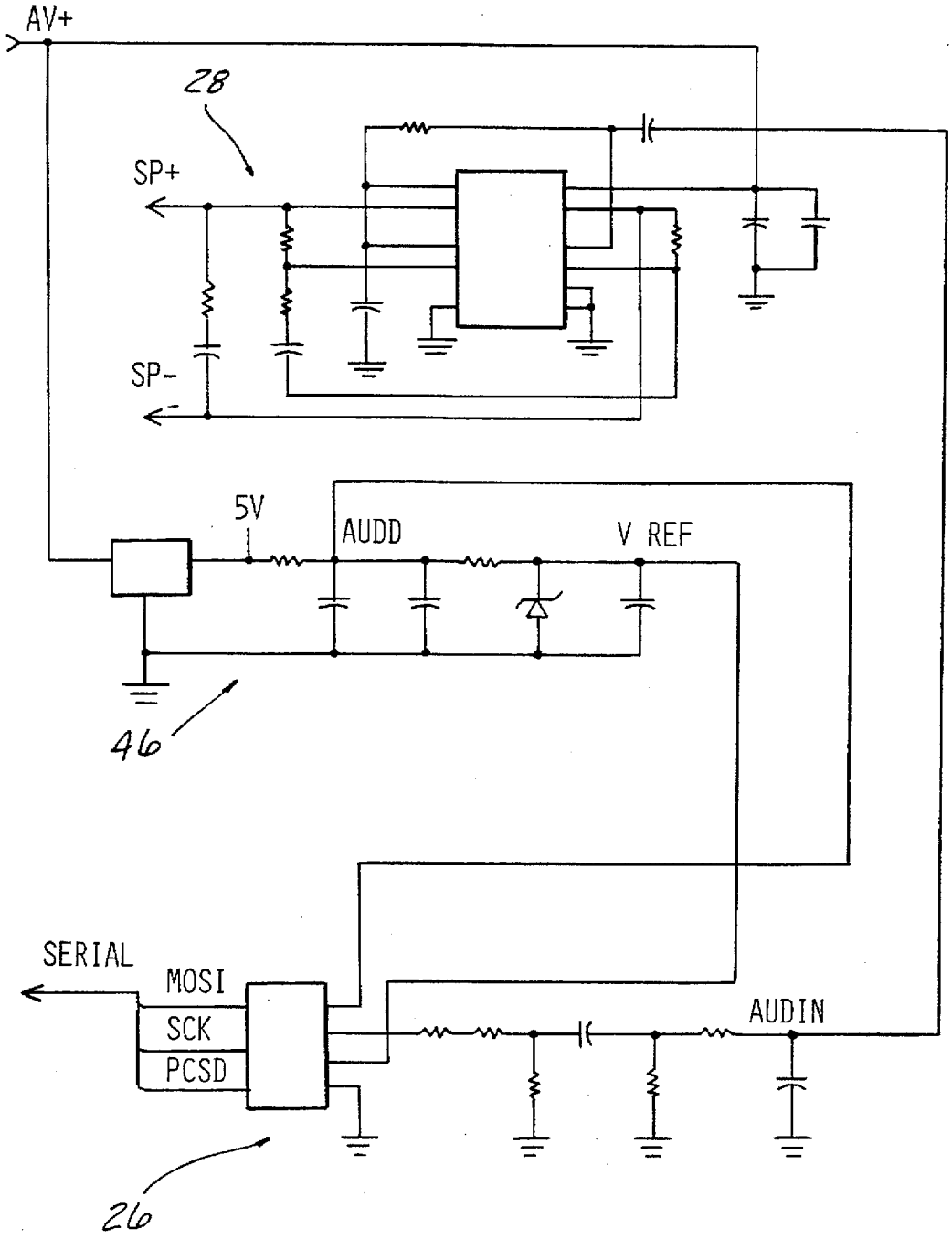

The VT1 and VT2 signals are also connected to an inverting switching regulator circuit 44, as shown in FIG. 4B. The circuit 44 includes an inverting switching regulator IC 45 Model No. LM3578A by National Semiconductor which raises the voltage of the battery 24 from a nominal 4V to 9V to power the audio amplifier 28 and the 5V central processing unit 14 when the battery 24 is used to power the circuit due to low track input voltage. The "AV+" output of the circuit 44 is supplied to a five volt supply circuit 46 using a linear regulator IC 47, the output of which provides separate signals labeled "AVDD" and "VREF". These reference signals "AVDD" and "VREF" are in turn connected to the dual channel amplifier circuit 28 and the digital to analog converter circuit 26 as shown in FIG. 4B.

Referring again to FIG. 3A, the central processing unit 14 is connected to the two memories 12 by means of an address bus 50. A data bus denoted generally by reference number 52 is output from each memory 12 to the central processing unit 14 for supplying the selected or addressed digital sound representations stored in the memory 12. The memories 12 also store the control program executed by the central processing unit 14 in a conventional manner.

Referring again to FIG. 3A, an oscillator circuit 54 is input to the central processing unit 14 to provide clock pulses utilized by the central processing unit 14. The various trigger inputs from the connectors are input to an opto-isolation circuit 58 which isolates the trigger inputs from output lines connected to the central processing unit 14. A reset signal labeled "RESET" from a MC34164-5 IC is also input to the central processing unit 14 to provide a reset signal.

The digital sound representations output from the memories 12 on data bus 52 to the central processing unit 14 are in turn output from the central processing unit 14 on a serial bus 60 through the connector 62 to the digital to analog converter 24. The digital to analog converter circuit 26 outputs audio signals labeled "AUDIN" to the dual channel amplifier 28 which supplies appropriate driver signals to the "SP+" and "SP-" terminals on the audio speaker 29 to generate the selected audible sounds.

In use, the central processing unit 14 determines the speed of the train 8 by the frequency rate of input of the trigger signals 16. In addition, the central processing unit 14 determines the increase or decrease of the speed of the train 8, the use of which will be described in greater detail hereafter. The following example of the use of the sound generating apparatus 10 of the present invention in generating realistic locomotive sounds will start from the initial start-up or movement of the train 8 from a stop position through the various speed ranges to a maximum speed and then decrease through the speed ranges back to a stop position. Variations in this speed pattern are also possible at the user discretion.

Once the train 8 begins to move from the initial start position, a trigger input 16 will be received by the central processing unit 14 once for each revolution of the wheel 32 when only one magnet 34 is mounted on the wheel 32. The rate of input of the trigger signal 16 will be determined by the central processing unit 14 to yield an indication that the train 8 is in the first speed range such that the central processing unit 14 provides appropriate address(es) on the address bus 50 to the memories 12 to select the first set of digital sound representations stored in the memory 12 pre-assigned to the first speed range. As described above, the first set of sound representations are stored in three subsets of four distinct sounds each. Upon initial start-up, the central processing unit 14 selects a first subset 1—1 and generates a distinct sound in sequential order from the first subset 1—1 upon each successive trigger signal 16. When all four distinct sounds in the first subset 1—1 have been generated, upon the next trigger input 16, the central processing unit 14, via its control program stored in the memory 12, is capable of randomizing the sounds generated from the set of sounds associated with the first speed range by use of a conventional random number generator to randomly select the second and third subsets 1–2 and 1–3 in the first set of sounds as well or to reselect the sounds in the first subset 1—1. This randomizing of sounds produces a more realistic representation of actual steam locomotive sounds since an actual steam locomotive does not generate the same sounds at a repetitive basis at a constant speed. Thus, each subset 1—1, 1–2 and 1–3, although containing four "chuff" sounds, will be provided with one or more louder sounds or one or more sounds of higher or lower pitch in a different sequence within each subset. The central processing unit 14 will continue to randomly select the various subsets 1—1, 1–2 and 1–3 in the first set of sounds as long as the train 8 remains in the first speed range.

When the rate of trigger signals 16 input to the central processing unit 14 increases to a speed that the central processing unit 14 determines to be in the second speed range, faster than the first speed range, the central processing unit 14 generates appropriate addresses on address bus 50 to the memories 12 to select digital sound representations stored in the memory 12 corresponding to the second set of sounds. The second set of sounds is also divided into three subsets 2-1, 2—2 and 2–3, each containing four distinct sounds, with each subset of sounds having certain distinct sounds provided at different volumes and/or different pitches. The central processing unit 14, after selecting and generating the digitally stored representations of sounds in the first subset 2-1 in the second set of sounds then randomly selects any of the three subsets 2-1, 2—2 and 2–3 in the second set of sounds as long as the train 8 remains in the second speed range.

This sequence is repeated as the train 8 increases in speed to the third or fourth speed ranges, in the present example, with the central processing unit 14 selecting the first subset 3-1 or 4-1 in each of the third and fourth speed ranges and then randomly selecting each subset 3-1, 3-2, 3—3 or 4-1, 4-2 or 4-3 in each of the third and fourth speed ranges. As the fourth speed range typically represents the maximum speed of the train 8, the memory 12 may store a digital sound representation of a whistle which can be stored at a separate memory location so as to be generated only when the subset 4-1 is selected for the first time by the central processing unit 14 whenever the model train 8 reaches the fourth speed range.

As noted above, the central processing unit in determining the rate of change of the trigger signal 16 input thereto, can also detect a decrease in speed of the train 8. Whenever a speed change is detected sufficient to indicate that the train is in a different speed range or at a preset speed, a separate sound may be generated, such as a whistle, to indicate a change in speed. Further, when the train 8 is slowing to a complete stop and the first speed range is indicated by the rate of trigger signal 16 input to the central processing unit 14, the central processing unit 14 can select and generate an audible sound stored in the memory 12 representing a station name and/or the ringing of a bell. A separate sound may also be generated as the train 8 begins its initial movement from a stop position, such as the ringing of a bell and/or an "all aboard" message.

According to another embodiment of the present invention, shown in FIG. 5, a single set of digital representations of sounds are stored in the memory 12. The single set includes a plurality of subsets, with two subsets being depicted by way of example only. Each subset, labelled subset 1 and subset 2, includes the same number of digital sound representations of a "chuff" sound. Four sound representations are stored in each subset 1 and 2 to correspond to the four exhaust "chuffs" of one cycle of a real train steam engine. Each sound representation in each subset 1 and 2 varies in volume and/or pitch to provide a plurality of distinct sound representations when each sound representation in either of the subsets 1 or 2 are reproduced.

According to this embodiment, the CPU 14 consecutively selects and generates four sound representations each time the single set of sound representations is to be generated, with each individual sound representation being selected and generated in response to a single trigger input from the moving object or train.

In this embodiment, the CPU 14 randomly selects one of the sound representations stored in the first, second, third and fourth consecutive positions in each subset 1 and 2. By example, when the first sound representation is to be generated, the CPU 14 randomly selects one of the sound representations denoted by numbers 1 and 5 in the chart shown in FIG. 5. Next, the CPU randomly selects one of the sound representations stored at locations 2 and 6. Similarly, sound representations at locations 3 or 7, and 4 or 8 are then consecutively selected by the CPU 14 and generated through the audible sound generating means 26, 28 and 29. This random selection provides a cycle of chaotic sound representations which breaks the monotony of merely reproducing the same pre-recorded sound representations in each subset over and over again.

Due to the random selection of a sound representation at each location from either subset 1 or 2, various combinations of sound representations are possible. Thus, sound representations may be generated for each set of sound representations in the following sequences: 1, 2, 3 and 4, or 5, 2, 3 and 4 or 1, 6, 3 and 8 and all other combinations thereof. In this manner, due to the random selection of sound representations from either of subsets 1 or 2 for each of the four sound representations that are to be generated for each complete set of sounds, a random generation of a number of different combinations of sound representations which vary in volume and/or pitch are possible.

The CPU 14, upon executing the control program stored in the memory 12, in either of the embodiments described above in which the sound representations are stored in different set and subset arrangements, is also capable of varying the length of time each individual sound representation or "chuff" sound is generated in proportion to the computed speed of movement of the object or train 8. FIG. 6 depicts an amplitude versus time representation of two consecutively generated sound representations 70 and 72, which sound representations are generated at a slow speed of movement of the object or train 8. Each sound representation 70 and 72 includes a leading edge or portion 74 in which the amplitude of the generated sound increases from zero to a maximum amplitude at point 76 and then decreases in a trailing portion 78 back to zero.

At increased or faster speeds of movement of the object or train 8, the CPU 14 via the control program stored in the memory 12 automatically shortens the duration or length of at least the leading portion 74 and preferably both the leading portion 74 and the trailing portion 78 of each sound representation by an amount proportional to the detected speed of the object or train 8. This is symbolically shown in FIG. 7 in which, in comparison to the amplitude versus time representation in FIG. 6, shows that the duration or length of time of both the leading portion 84 and the trailing portion 88 of each sound representation 80 and 82 has been shortened by an amount proportional to the increase in speed of the object or train 8 from the speed corresponding to FIG. 6.

In this manner, as the speed of the object or train 8 increases from a slow speed, the duration or length of time that each digital sound representation is generated will be proportionately shortened to more closely correspond to the shortened duration of each sound or "chuff" in a full size train steam engine.

The CPU 14 proportionally lengthens each leading portion 84 and trailing portion 88 from that shown in FIG. 7 back to that depicted in FIG. 6 on detecting and computing a decrease in the speed of the train 8.

Further, the CPU 14 can access other distinct sound representations, such as a whistle, bell, steam release, etc., which are stored in the memory 12 upon computing a preset speed of the object or train 8. Such sounds can be generated individually or in groups on both increasing and decreasing object speeds.

In summary, there has been disclosed a unique sound generating apparatus for use with various objects, such as toys, and in particular, model trains, which generates realistic sounds similar to those found in a corresponding full size object, such as a real steam locomotive. Real sounds are digitized and stored in a memory as digital sound representations in various sequences which are selected by the central processing unit in response to the speed of movement of the object, such as a train. This provides a more realistic sound as a corresponding real object, such as a train, randomly produces different volume and pitch sounds even if it is moving at a constant speed. In this manner, a model train operator can cause the model train to issue various sounds solely by changing the speed of the train. This eliminates the external switches, magnets and other devices previously used in model train layouts to provide such sounds. Further, such sounds can be generated at any position along the track layout rather than at a set position as in prior model train layouts. Further, as the model train may automatically slow down or speed up due to track conditions, such as dirt on the track, inclines, curves, and the like, the resulting speed change will automatically alter the sounds generated by the locomotive in the same manner as in a real steam locomotive.

Further, as the output sounds generated by the sound generating apparatus of the present invention are a function of actual object or train speed, trains having different voltage requirements for identical speeds are unaffected. Another advantage is that the same model train engine will always issue the proper sounds at the selected speed regardless of the number of cars attached to the engine since the sound generation is tied directly to engine speed and not to the amount of power required to move the train around the track layout.

What is claimed is:

1. A sound generating apparatus for a movable object comprising:

memory means for storing digital representations of actual sounds in a plurality of discrete sets, each set assigned to one of a plurality of distinct speed ranges of movement of an object, each set including a plurality of subsets, each subset containing different sound representations;

means, mounted on the movable object, for generating periodic output signals during movement of the object;

central processing means, connected to the memory means and responsive to the periodic output signals and executing a control program stored in the memory means, for computing the speed of the object and for randomly selecting one of the plurality of subsets corresponding to a speed range based on the computed speed of movement of the object, and outputting sound representations from the selected subset at a rate corresponding to the speed of movement of the object, the central processing means randomly selecting the subsets and repeatedly and successively outputting the digital representations of sounds from one set of digital representations of sounds as long as the computed speed of the object remains in one speed range; and audible sound generator means, responsive to the selected digital representations of sounds output from the central processing means, for converting the digital representations of sound to audible sounds.

2. The sound generator apparatus of claim 1 wherein:

the digital representations of sounds stored in the memory means are digitized from naturally occurring sounds associated with movement of a full size object.

3. The sound generator apparatus of claim 1 wherein the means for generating periodic output signals comprises:

switch means, mounted on the object, for generating an output signal for each of a selected amount of movement of the object.

4. The sound generating apparatus of claim 1 wherein:

the digital representations of sounds in each subset include at least one sound which varies in at least one of the volume and pitch.

5. The sound generating apparatus of claim 1 wherein the object is a movable model train.

6. The sound generating apparatus of claim 1 wherein:

the subsets include an identical number of digital representations of sounds.

7. A sound generating apparatus for a movable object comprising:

memory means for storing digital representations of actual sounds in at least one discrete set, the at least one set including a plurality of subsets, each subset including an identical number of at least first; second, third and fourth consecutive sound representations;

means, mounted on the movable object, for generating periodic output signals during movement of the object;

central processing means, connected to the memory means and responsive to the periodic output signals and executing a control program stored in the memory means, for computing the speed of the object and for randomly selecting one of the plurality of subsets corresponding to the speed of movement of the object, the central processing means randomly selecting and consecutively outputting the first, second, third and fourth sound representations of each selected subset for each set; and audible sound generator means, responsive to the selected digital representations of sounds output from the central processing means, for converting the digital representations of sounds to audible sounds.

8. A sound generating apparatus for a movable object comprising:

memory means for storing digital representations of actual sounds in at least one discrete set, the at least one set including a plurality of subsets, each subset formed of an identical number of at least first and second distinct sound representations;

means, mounted on the movable object, for generating periodic output signals during movement of the object;

central processing means, connected to the memory means and responsive to the periodic output signals and executing a control program stored in the memory means, for computing the speed of the object and for selecting and outputting sound representations from the plurality of subsets at a rate corresponding to the speed of movement of the object, the central processing means randomly selecting and consecutively outputting one of the first sound representations of each of the plurality of subsets, and then one of the second sound representations of each of the plurality of subsets; and audible sound generator means, responsive to the selected digital representations of sounds output from the central processing means, for converting the digital representations of sounds to audible sounds.

9. A sound generating apparatus for a movable object comprising:

memory means for storing digital representations of actual sounds in at least one discrete set, the at least one set including a plurality of subsets, each subset formed of an identical number of distinct sound representations;

each digital sound representation in each subset has a varying amplitude versus time profile increasing from zero to a maximum amplitude and back to zero;

each profile having a leading portion, a central maximum amplitude portion, and a trailing portion;

means, mounted on the movable object, for generating periodic output signals during movement of the object;

central processing means connected to the memory means and responsive to the periodic output signals and executing a control program stored in the memory means, for computing the speed of the object and for randomly selecting and outputting sound representations from the plurality of subsets at a rate corresponding to the speed of movement of the object; the central processing means, in response to the speed of the object and to the control program, varying the length of at least the leading portion of the profile of each sound representation in proportion to the speed of the object; and audible sound generator means, responsive to the selected digital representations of sounds output from the central processing means, for converting the digital representations of sounds to audible sounds.

10. The sound generating apparatus of claim 9 wherein:

the central processing means also varies the length of the trailing portion of the profile of each sound representation in proportion to the speed of the object.

11. The sound generating apparatus of claim 1 further comprising:

individual sound representations stored in the memory means, each individual sound representation preassigned to a preset speed of the object, and the central processing means including means, responsive to the computed speed of the object, for selecting and outputting the individual sound representations when the computed speed of the object equals the preset speed preassigned to each individual sound representation.

* * * * *